United States Patent [19]

Ricketts

[11] 4,443,037

[45] Apr. 17, 1984

[54] METHOD FOR CONTROLLING VOID FRACTION DISTRIBUTION IN AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 316,103

[22] Filed: Oct. 28, 1981

[51] Int. Cl.[3] ..... E21B 43/247; E21C 41/10

[52] U.S. Cl. ..... 299/2; 166/259; 299/13

[58] Field of Search ..... 299/2, 13, 19; 166/259

[56] References Cited

U.S. PATENT DOCUMENTS

| | | | |
|---|---|---|---|
| 3,951,456 | 4/1976 | Ridley | 299/2 |
| 4,109,964 | 8/1978 | Ridley | 299/13 X |
| 4,147,388 | 4/1979 | French | 299/2 |
| 4,266,612 | 5/1981 | French | 299/13 |

*Primary Examiner*—George A. Suchfield
*Attorney, Agent, or Firm*—Christie, Parker & Hale

[57] ABSTRACT

A method for forming an in situ oil shale retort in a retort site in a subterranean formation is provided. The in situ oil shale retort contains a fragmented permeable mass of oil shale particles formed within top, bottom, and side boundaries of the retort site. At least one void is excavated in the subterranean formation within the boundaries of the retort site, while a zone of unfragmented formation is left within the boundaries of the retort site adjacent such a void. An inlet is formed in a zone of the retort adjacent the intersection of a first side boundary of the retort site and the top boundary of the retort site and an outlet is formed in a zone of the retort adjacent the intersection of a second side boundary of the retort site and the bottom boundary of the retort site. The second side boundary is on the opposite side of the retort site from the first side boundary. An array of explosive charges is formed in the zone of unfragmented formation and the charges are detonated for explosively expanding the zone of formation toward the void for forming the fragmented mass within the boundaries of the retort site. The explosive charge pattern and detonation sequence are provided so that the fragmented mass formed has a lower void fraction in a center region of the retort and a higher void fraction in regions of the retort adjacent the side boundaries.

13 Claims, 5 Drawing Figures

METHOD FOR CONTROLLING VOID FRACTION DISTRIBUTION IN AN IN SITU OIL SHALE RETORT

FIELD OF THE INVENTION

This invention relates to in situ recovery of shale oil and, more particularly, to a method for forming and operating an in situ oil shale retort with enhanced uniformity of gas flow.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 (now abandoned) filed Aug. 27, 1979, by Chang Yul Cha, entitled *TWO-LEVEL, HORIZONTAL FREE FACE MINING SYSTEM FOR IN SITU OIL SHALE RETORTS.* Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids of similar horizontal cross-section are initially excavated one above another within the retort site. A plurality of vertically spaced apart zones of unfragmented formation are temporarily left between the voids. A plurality of horizontally spaced apart vertical columnar explosive charges, i.e., an array of explosive charges, is placed in each of the unfragmented zones and detonated to explosively expand each unfragmented zone upwardly and/or downwardly toward the void or voids above and/or below it to form a fragmented mass having an average void volume about equal to the void volume of the initial voids. Retorting of the fragmented mass is then carried out to recover shale oil from the oil shale.

U.S. patent application Ser. No. 070,319 discloses a method for explosively expanding formation containing oil shale toward a horizontal free face to form a fragmented mass in an in situ oil shale retort. According to such a method, a void having a horizontal cross-section similar to the horizontal cross-section of the retort being formed is initially excavated. A plurality of vertically spaced apart zones of unfragmented formation are left above the void. Explosive is placed in each of the unfragmented zones and detonated for explosively expanding such zones toward the void to form a fragmented mass in the retort having an average void volume about equal to the void volume of the initial void. The overlying zones can be expanded toward the void in a single round or a plurality of rounds. Retorting of the fragmented mass is then carried out to recover shale oil from the oil shale.

It has been determined that the efficiency of in situ retorting of oil shale is enhanced when gas flow through all regions of the fragmented mass of formation particles in the retort is uniform.

To enhance uniform gas flow through vertical in situ oil shale retorts, techniques have been developed for forming a fragmented permeable mass in such a retort which has a reasonably uniform permeability in horizontal planes across the retort. This eliminates bypassing portions of the fragmented mass due to gas channeling and results in improved yields of shale oil from the retorting process.

However, when the permeability of a fragmented mass of formation particles is reasonably uniform in horizontal planes across a vertical retort, gas flow may still not be completely uniform. This is because it may not be practical or economical to provide enough retort fluid inlets and outlets at locations necessary to result in equal length fluid flow paths throughout the entire fragmented mass between such inlets and outlets. In other words, with a limited number of retort fluid inlets and outlets, it is necessary for retoring fluids to traverse various length paths if the entire fragmented permeable mass is to be effectively contacted by the fluids.

When the permeability of the fragmented mass is uniform, as described above, the gas velocity along each flow path is theoretically about inversely proportional to the length of the flow path. Thus, the velocity of gas flow along a shorter path between a retort inlet and outlet will be higher than the velocity of the gas flow along a longer path. It has been estimated theoretically and determined experimentally that the rate of flame front or combustion zone advance through a fragmented mass is proportional to the gas velocity. Therefore, a combustion zone advances more rapidly through a fragmented mass along shorter gas flow paths and less rapidly along gas flow paths of greater length.

Therefore, when all gas flow paths through a fragmented mass are not equal and the permeability is uniform, the combustion zone will not advance in a flat, planar wave, but will be skewed. This can decrease the efficiency of the retorting operation.

One attempt to solve the problem of uneven retorting fluid flow through a vertical retort is disclosed in U.S. Pat. No. 3,951,456 to Ridley. This patent discloses a vertical retort with one or more fluid inlets through its top and one or more fluid outlets at its bottom. If desired, the fluid outlets can be at the periphery of the retort. It is disclosed that the rubble pile in the retort has a variable bulk permeability which increases from the shortest to the longest flow path between a retorting fluid entrance and exit.

The rubble pile is retorted progressively from the top to the bottom, i.e., the combustion zone moves vertically through the retort.

Alternatively, however, it can be desirable in an in situ oil shale retort to introduce combustion supporting gas to the fragmented mass along one upper edge of the retort and withdraw gas from along the opposite lower edge. Thus, the direct gas flow path through the fragmented mass is skewed from vertical and extends generally diagonally across the retort. This is considered desirable for several reasons, one of which being that the difference between the longest and shortest gas flow paths through the fragmented mass is reduced compared, for instance, to the difference in the longest and shortest gas flow paths through a retort having one inlet at the center of the top and one outlet at the bottom.

There is a need for providing such a retort with enhanced uniformity of gas flow.

SUMMARY OF THE INVENTION

This invention relates to an in situ oil shale retort with enhanced uniformity of gas flow. The retort has top, bottom, and side boundaries of unfragmented formation and is in a retort site in a subterranean formation containing oil shale. At least one retort inlet is in a zone of the retort adjacent the intersection of a first side boundary of the retort site and the top boundary of the retort site for introduction of a retort inlet mixture. At least one retort outlet is in a zone of the retort adjacent the intersection of a second side boundary of the retort site and the bottom boundary of the retort site for withdrawal of off-gas. The second side boundary is on the opposite side of the retort from the first side boundary. A fragmented permeable mass of formation particles extends between such a retort inlet and such a retort outlet. The fragmented mass has a lower void fraction along the shortest fluid flow path through the fragmented mass from the retort inlet to the retort outlet and a higher void fraction along the longest fluid flow path through the fragmented mass from the retort inlet to the retort outlet.

In one exemplary embodiment of forming an in situ oil shale retort in accordance with this invention, at least one void is excavated in the subterranean formation within the boundaries of the retort site and a zone of unfragmented formation is left within the boundaries of the retort site adjacent such a void. The zone of unfragmented formation comprises four contiguous regions with each such region having a horizontally extending free face adjacent the void. An array of explosive charges is formed in the zone of unfragmented formation. The array of charges comprises at least one first explosive charge in a central portion of each such region of the zone surrounded by a plurality of second explosive charges in a portion of each such region laterally spaced from the central portion and adjacent the central portion. The explosive charges are detonated in a single round for explosively expanding the zone of unfragmented formation toward the void for forming a fragmented permeable mass of formation particles in the retort. The detonation sequence comprises detonating the first explosive charges in each such region of the zone for explosively expanding the central portion of each such region toward the void. Thereafter, the second explosive charges in each such region of the zone are detonated for explosively expanding the portion of each region laterally spaced from the central portion and adjacent the central portion toward the void to thereby form the fragmented permeable mass of formation particles. The fragmented mass has a void fraction in a center region of the retort that is less than the void fraction in regions of the retort nearer the retort boundaries.

In yet another exemplary embodiment of forming an in situ oil shale retort in accordance with this invention, at least one void is excavated in the subterranean formation within the boundaries of the retort site, while leaving a zone of unfragmented formation within the boundaries of the retort site adjacent such a void. An array of horizontally spaced apart explosive charges is formed in the zone of unfragmented formation extending across substantially the entire horizontal cross-section of such a zone. The explosive charges are detonated in a single round in a time delay sequence for explosively expanding the zone of unfragmented formation toward the void for forming a fragmented mass of formation particles in the in situ oil shale retort. The detonation sequence comprises detonating at least one first explosive charge located at about the center of the zone of unfragmented formation and then, after a first time delay, detonating explosive charges progressing in bands generally radially outwardly from such a first explosive charge. A time delay is provided between detonation of each successive band of explosive charges. The fragmented mass formed by such a detonation sequence has a lower void fraction in a center region of the retort and a higher void fraction in regions of the retort adjacent the side boundaries.

DRAWINGS

These and other features, aspects, and advantages of the present invention will be more fully understood when considered with respect to the following detailed description, appended claims, and accompanying drawings wherein:

DETAILED DESCRIPTION

Figure 1:
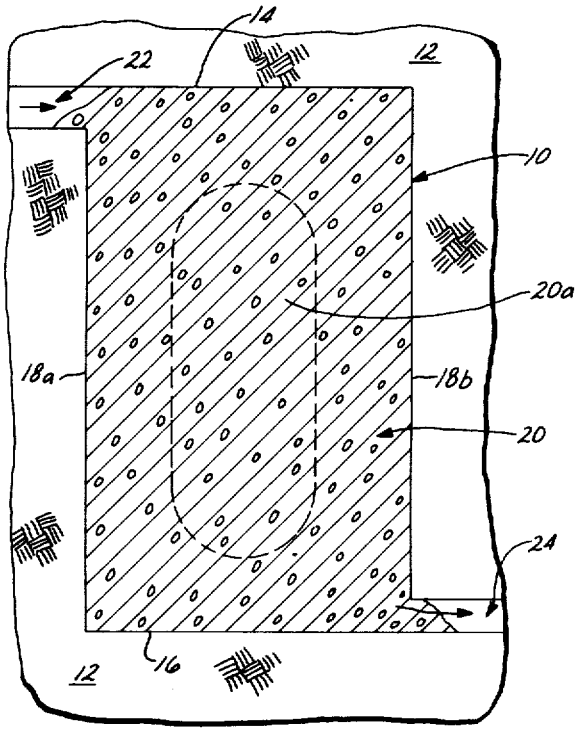
FIG. 1 is a semi-schematic vertical cross-sectional view of an in situ oil shale retort containing a fragmented permeable mass of formation particles provided in accordance with practice of principles of this invention.

Referring to FIG. 1, there is shown a semi-schematic, vertical, cross-sectional view of an exemplary embodiment of an in situ oil shale retort 10 provided in accordance with practice of principles of this invention.

The retort 10 is in a retort site in a subterranean formation 12 containing oil shale and has a top boundary 14, a bottom boundary 16, and four generally vertically extending side boundaries 18 of unfragmented oil shale formation. In this embodiment, the retort is generally rectangular in horizontal cross-section, but retorts having horizontal cross-sections other than rectangular can also be formed if desired.

The in situ retort contains a fragmented permeable mass of formation particles 20 having a non-uniform void fraction distribution for enhancing uniformity of gas flow through the retort. This is described below in greater detail.

In one embodiment of the in situ oil shale retort 10, it is desirable to ignite the retort and introduce a combustion-supporting gas, such ans oxygen, air, or air or oxygen diluted with steam or off-gas or the like, through a drift, i.e., through a retort inlet 22. The retort inlet 22 is preferably at an upper edge of the retort in a zone adjacent the intersection of a first side boundary 18*a* of the retort site and the top boundary 14 of the retort site. Alternatively, ignition and introduction of a retort inlet mixture, i.e., the combustion-supporting gas, can be through a plurality of drifts or boreholes (either vertical or horizontal or at some intermediate inclination) into the retort in a zone adjacent one upper edge.

Off-gas and liquid products are withdrawn from the retort through a drift, i.e., a retort outlet 24. Preferably, the retort outlet 24 is in a zone adjacent the intersection of a second side boundary 18*b* of the retort site and a bottom boundary 18 of the retort site. The second side boundary 18*b* is on the opposite side of the in situ retort from the first side boundary 18*a*, i.e., the retort outlet 24 communicates with the retort in a zone adjacent the lower edge of the retort opposite the retort inlet 22. Alternatively, off-gas can be withdrawn through a plurality of drifts or boreholes which communicate with the retort in a zone adjacent such an opposite or lower edge.

It will be understood that, as used herein, the terms "inlet" and "outlet" each include either a single opening or a plurality of openings for gas flow.

As described above, it has been determined that the efficiency of in situ retorting of oil shale is enhanced when gas flow through all regions of the fragmented mass of formation particles in the retort is uniform. To enhance uniform gas flow through vertical in situ retorts, techniques have been developed for forming a fragmented permeable mass in such a retort which has a reasonably uniform permeability in horizontal planes across the retort. This can eliminate bypassing of portions of the fragmented mass due to gas channeling, but does not provide uniform gas flow in a retort with an inlet 22 and an outlet 24 positioned as described above. This can be better understood by referring to FIG. 2.

Figure 2:
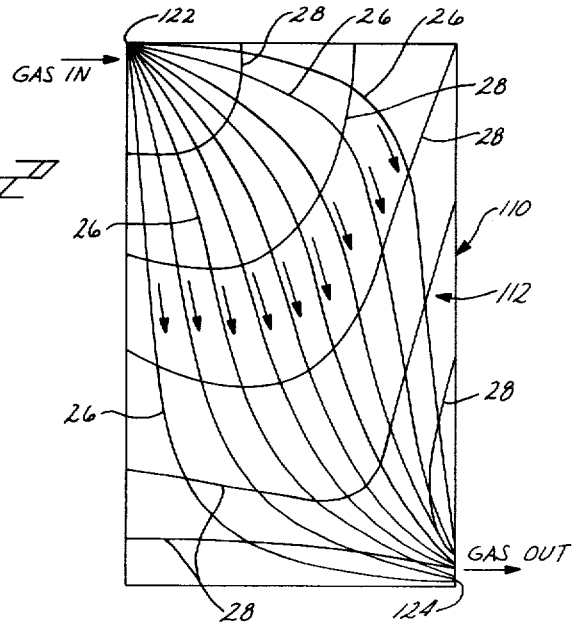
FIG. 2 is a semi-schematic vertical cross-sectional view illustrating a calculated pattern of gas flow and the shape and movement of a combustion zone through an in situ oil shale retort having an inlet at the top on one side and an outlet at the bottom on the other side and containing a fragmented permeable mass of formation particles having a uniform void fraction distribution.

FIG. 2 illustrates the direction of gas flow and the general shape of a combustion zone as it advances through a retort 110 having an inlet 122 and an outlet 124 positioned as described for the exemplary retort 10 and, additionally, containing a fragmented mass 112 with a uniformly distributed void fraction. The direction of gas flow and shape of the combustion zone were determined mathematically.

Gas flow through the retort 110 is depicted for illustrative purposes, as being along a plurality of streamlines 26, each of which extends from the inlet 122 to the outlet 124. Although any number of streamlines can be calculated, for purposes of exposition herein, only nine are shown. Each such streamline is drawn so that each portion along its length is perpendicular to lines of equal pressure, i.e., isobars, through the retort. The lines of equal pressure are not shown since they are not needed for an understanding of this concept. It is believed that a portion of the gas introduced into the retort travels along each streamline through the fragmented mass 112 from the inlet 122 to the outlet 124. Gas flow, therefore, passes generally diagonally through the retort from the retort inlet to the retort outlet along such streamlines.

Theoretically, the gas velocity along each streamline is approximately inversely proportional to the length of the streamline. Further, it has been estimated theoretically and determined by experiment that the rate of flame front or combustion zone advance through the fragmented mass is proportional to the gas velocity.

In this illustration, lines 28 indicate the shape and movement of the combustion zone at a series of time intervals during retorting operations, as it advances from the inlet 122 diagonally downwardly through the fragmented mass 112 to the outlet 124.

As is shown in FIG. 2, the combustion zone advances more rapidly along the relatively shorter gas flow paths or streamlines than along the gas flow paths or streamlines that are relatively longer. Thus, the combustion zone is not flat as it advances diagonally through the retort from the inlet to the outlet, but has a portion that is nearer the outlet 124 and other portions that are farther from the outlet.

When the combustion zone is not flat, the efficiency of the retorting operation can be reduced. For example, retorting operations are desirably stopped before off-gas temperatures increase sufficiently to damage recovery equipment. The temperature of the off-gas is increased as the combustion zone approaches the outlet of the retort. Therefore, when the combustion zone is not flat, some portions reach the outlet(s) before other portions. This can result in off-gas temperatures being high enough to require that retorting be discontinued before all of the oil shale in the retort is processed.

As mentioned above, the fragmented mass 20 provided in accordance with this invention in the retort 10 has a non-uniformity of void fraction distribution for enhancing the flatness of the combustion zone moving through the retort. To provide a combustion zone with enhanced flatness, the fragmented mass 20 has a lower void fraction in shorter gas flow paths and a somewhat higher void fraction in the longer gas flow paths to equalize gas flow along such paths.

Referring again to FIG. 1, during retorting operations, the fragmented mass 20 is ignited and combustion-supporting gas is introduced at the upper edge of the retort through the inlet 22. Off-gas is withdrawn from the fragmented mass through the retort outlet 24 at an opposite lower edge of the retort. Thus, as described above, the principal gas flow direction is diagonally through the fragmented mass from the upper level drift 22 toward the lower level drift 24. Therefore, as can be seen in FIG. 2, the shorter gas flow paths are through the center of the fragmented mass in the retort and the longer paths are spaced laterally from the center toward the side boundaries.

In practice of this invention, a central region **20*a* of the fragmented mass (depicted schematically by dashed lines) has a somewhat lower void fraction than the average void fraction of the mass. The permeability of the fragmented mass is affected by the void fraction, lower void fraction regions having higher resistance to gas flow than higher void fraction regions. Permeability is also influenced by particle size and particle size distribution, smaller particles having higher gas flow resistance than larger particles. The low void fraction region 20*a* lies athwart the shortest gas flow path through the retort, tending to cause some gas diversion toward the longer gas flow paths surrounding the low void fraction region. For example, the low permeability region tends to cause more gas flow laterally from the inlet 22 across an upper portion of the retort and then more directly downwardly toward the retort outlet 24 and also downwardly from the inlet 22 and then more horizontally toward the outlet 24**. Thus, the gas velocity along all of the flow paths through the retort tends to be equalized because of the non-uniform permeability distribution within the fragmented mass.

The low void fraction region **20*a*** is formed by explosively expanding oil shale toward one or more voids formed within the top, bottom, and side boundaries of the retort site. The formation of the low void fraction region is promoted by the pattern of explosive charges, time delays, and sequence used for initiation of detonation of the charges used for explosive expansion of the oil shale.

Figure 3:
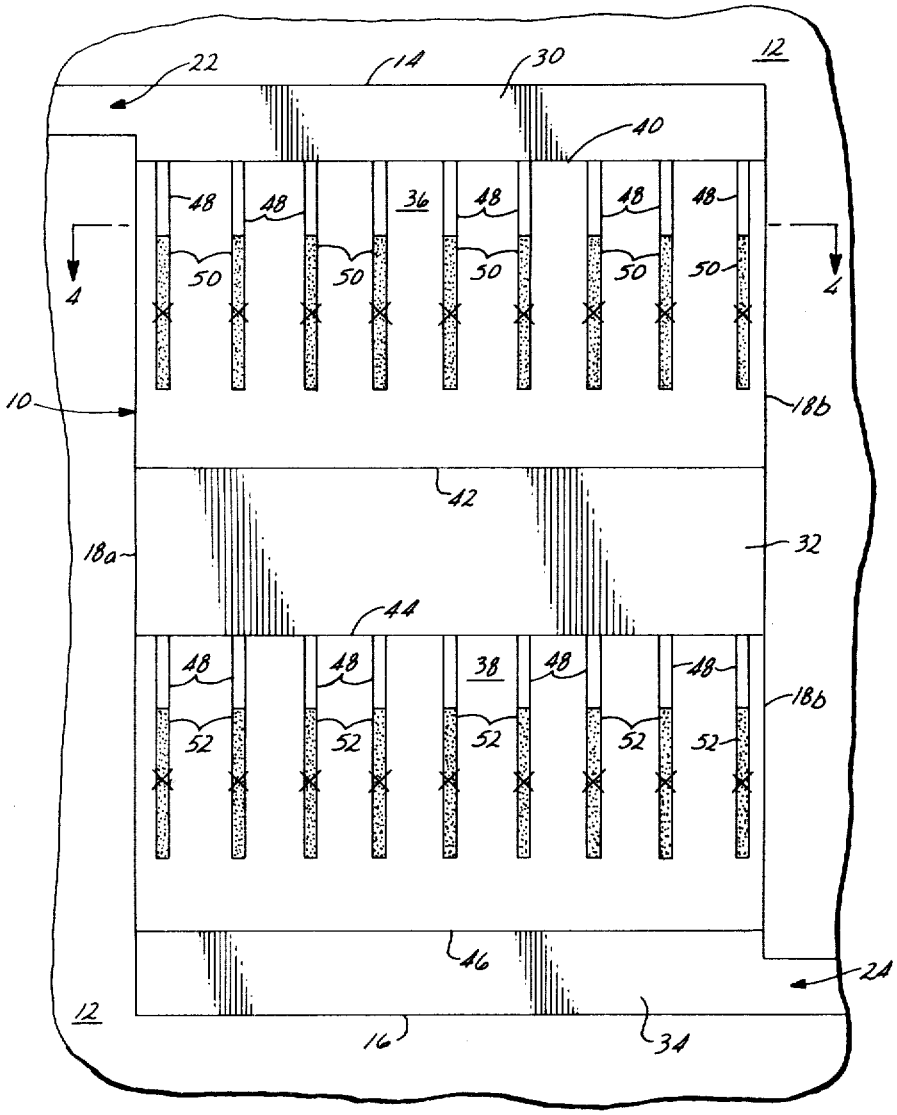
FIG. 3 is a semi-schematic vertical cross-sectional view of the in situ oil shale retort of FIG. 1 at one stage of preparation in accordance with this invention.
Figure 4:
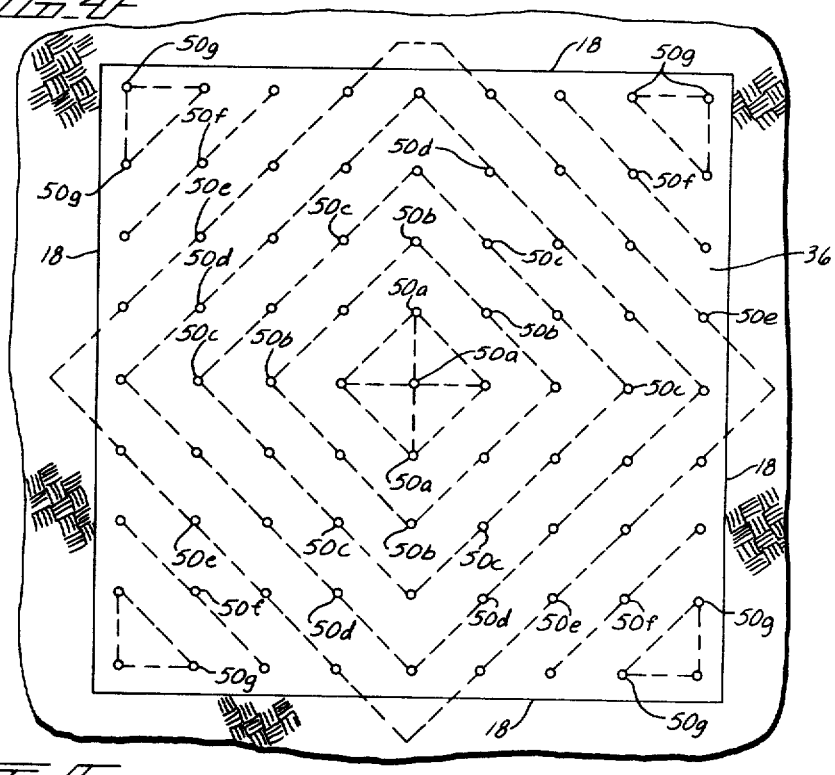
FIG. 4 is a semi-schematic horizontal cross-sectional view taken on line 4—4 of FIG. 3 showing an exemplary blasting pattern useful in practice of principles of this invention.
Figure 5:
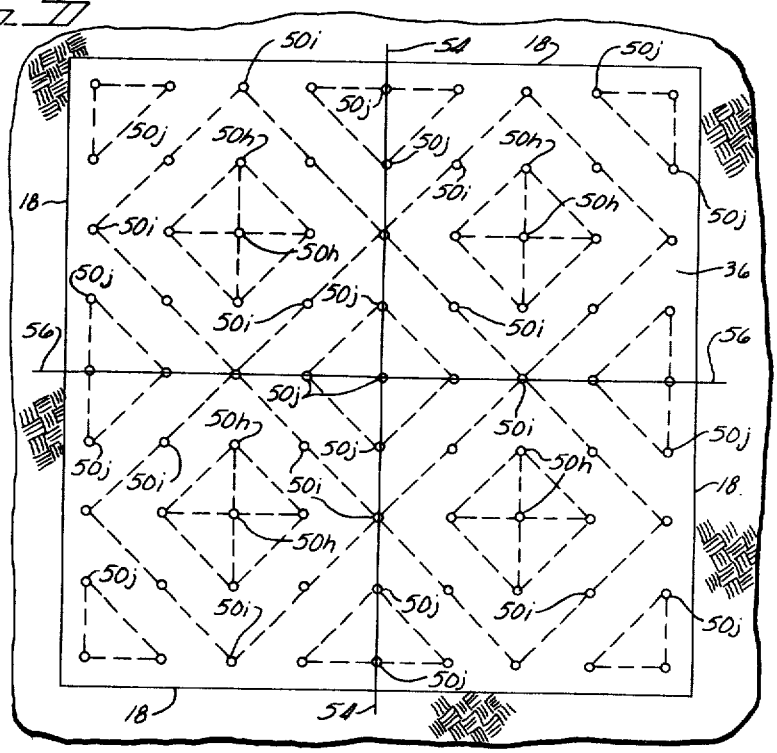
FIG. 5 is a semi-schematic horizontal cross-sectional view of the zone of unfragmented formation of FIG. 4 showing another exemplary blasting pattern useful in practice of this invention.

Details of exemplary embodiments of practice of this invention useful for forming the in situ oil shale retort 10 having a fragmented mass 20 with such a non-uniformly distributed void fraction can be understood by referring to FIGS. 3–5.

Referring particularly to FIG. 3, there is shown a semi-schematic vertical cross-sectional view of the in situ oil shale retort 10 at one stage during its formation in accordance with an exemplary embodiment of practice of this invention. The retort 10 is in the subterranean formation 12 containing oil shale and, as described above, has a top boundary 14, vertically extending side boundaries 18, and a bottom boundary 16 of unfragmented formation.

A generally horizontally extending upper level void 30, a generally horizontally extending intermediate void 32, and a generally horizontally extending lower level void 34 are excavated into the formation within the boundaries of the retort site. Preferably, the voids are all about equal in horizontal cross-section and are located vertically one above the other.

An upper zone 36 of unfragmented formation is left within the side boundaries of the retort extending between the upper and intermediate voids 30 and 32, respectively. A lower zone 38 of unfragmented formation is left within the side boundaries of the retort extending between the intermediate and lower voids 32 and 34, respectively.

The upper zone 36 of unfragmented formation has a horizontally extending upper free face 40 defining the floor of the upper void 30 and a horizontally extending lower free face 42 defining the roof of the intermediate void 32. The lower zone of unfragmented formation has a horizontally extending upper free face 44 defining the floor of the intermediate void and a horizontally extending lower free face 46 defining the roof of the lower void 34. As is described in greater detail below, the zones of unfragmented formation are explosively expanded upwardly and downwardly toward the voids to form the fragmented permeable mass of formation particles 20 in the retort.

Excavation of the upper void 30 can be by means of access through a horizontally extending upper level drift 22 which extends through a first side boundary **18*a* of the retort site. The upper level drift 22 is preferably adjacent or above the top boundary 14** of the retort site. If desired, more than one such upper level drift can be used.

Excavation of the lower void 34 can be by means of access through a horizontally extending lower level drift 24 which, in this instance, extends through a second side boundary **18*b* of the retort site opposite the first side boundary. The lower level drift 24** is preferably adjacent or below the bottom boundary of the retort site. If desired, more than one such lower level drift can be used.

Excavation of the intermediate void 32 can be by means of access through a horizontally extending intermediate drift (not shown) which, in this instance, can extend through any of the side boundaries of the retort site. Such a drift is sealed during retorting operations.

In an exemplary embodiment of practice of this invention, the first side boundary **18*a* is on the opposite side of the retort site from the second side boundary 18*b* and, during retorting operations, the upper level drift(s) 22 is used for ignition and introduction of combustion-supporting gases into the retort, while the lower level drift(s) 24** is used for withdrawal of off-gas and products of retorting.

If desired, one or more support pillars (not shown) can be left in each void for temporarily supporting overlying unfragmented formation while the zones of unfragmented formation 36 and 38 are being prepared for explosive expansion. When pillars are left in the voids, they are explosively expanded prior to explosive expansion of the zones of unfragmented formation. Explosive expansion of the pillars can be accomplished either in the same round as the expansion of the zones of unfragmented formation or in separate rounds if desired.

The volume of formation excavated to form the voids toward which unfragmented formation is explosively expanded is preferably between about 15 and about 40 percent of the total volume of the retort being formed. That is, the amount of formation mined is preferably between 15 to 40 percent of the total volume within the top, side, and bottom boundaries of the retort.

It has been determined that voids comprising up to substantially greater than 40 percent of the total volume within the top, side, and bottom boundaries of a retort toward which unfragmented formation is to be expanded can act as "limited voids". A "limited void" is a void having a volume less than the volume required for free expansion of all the oil shale explosively expanded toward such a void. When oil shale is explosively expanded toward an unlimited void, a certain maximum void fraction is present in the unfragmented mass, resulting from such free expansion. When oil shale is expanded toward a limited void, the void fraction can be no more than permitted by the available void space of the limited void and may be less due to the interactions with unfragmented oil shale, for example. It is believed that with oil shale confined by surrounding walls and capable of expanding only to such a limited void, gases from the detonation of explosives may not have full opportunity to act on the oil shale particles before such particles reach obstructions, such as adjacent walls, a face opposite to the expanded formation, or oil shale expanding from the opposite sides of the void.

In accordance with this invention, the location of placement of explosive charges in the zones of unfragmented formation 36 and 38 and the timing sequence used in the round detonations of the explosive charges controls the void fraction distribution in the fragmented mass 20 in the retort.

In the illustrated embodiment, a plurality of vertically extending blastholes 48 are drilled into each of the zones 36 and 38 of unfragmented formation. The blastholes 48 are drilled either from the void above such zone of unfragmented formation or from the void below it. In this embodiment, the blastholes are drilled from the voids above each respective zone of unfragmented formation and extend in a square array substantially across the entire horizontal cross-section of each zone. By a "square array," it is meant that the spacing distance between each adjacent pair of charges in the array is about equal. Also, although all the blastholes shown in this embodiment have about the same diameter, if desired, blastholes having different diameters can be used in the same array.

An explosive charge 50 is placed into each of the blastholes 48 in the upper zone 36, preferably in about the middle half of the upper zone, forming an array of horizontally spaced apart explosive charges 50. A plane passing through the centers of the charges 50 is preferably about parallel to the free faces 40 and 42.

An explosive charge 52 is placed into each of the blastholes 48 in the lower zone 38, preferably in about the middle half of the lower zone, forming an array of horizontally spaced apart explosive charges 52. A plane passing through the centers of the charges 52 is preferably about parallel to the free faces 44 and 46.

Detonators designated by an "x" are in each charge 50 and 52, preferably at about the center of each charge column. Stemming is placed in each blasthole between the charge and the blasthole opening or collar.

Referring now to FIGS. 4 and 5, exemplary patterns of explosive charges 50 and 52 provided in accordance with this invention illustrating their preferred location and sequence of detonation can be understood.

Preferably, such a pattern of explosive charges and their detonation sequence are the same for both layers or zones 36 and 38 of unfragmented formation. Thus, the pattern and detonation sequence is described in detail below for only one of the zones; in this instance, the upper zone 36.

Referring particularly to FIG. 4, a horizontal cross-sectional view of the upper zone 36 of unfragmented formation is shown. The array of explosive charges 50 is a square array and, as described above, the array extends across the entire horizontal cross-section of the zone of unfragmented formation.

Explosive expansion of the upper layer upwardly toward the void 30 and downwardly toward the void 32 is accomplished in this embodiment by first initiating detonation of five explosive charges **50*a* at about the center of the upper layer. In each instance, the charges detonated on the same time delay are shown connected by dashed lines. After a time delay, eight explosive charges 50*b* located in a band surrounding the five charges 50*a* are detonated. The time delay between detonations is preferably at least about 1 millisecond per foot of spacing between adjacent charges 50*a* and 50*b* and can be several milliseconds per foot of spacing distance. After an additional time delay, twelve explosive charges 50*c* in a band surrounding the explosive charges 50*b* are detonated. Preferably, the time delay between detonation of the explosive charges 50*b* and the charges 50*c* is preferably at least about 1 millisecond per foot of spacing distance between adjacent explosive charges 50*b* and 50*c* and can be several milliseconds per foot. In this embodiment, the detonation sequence continues to progress radially or laterally outwardly from the center of the zone of unfragmented formation 36 until all of the explosive charges 50 are detonated. This pattern or sequence of time delays used for detonating the array of explosive charges 50** is referred to herein as a "center-out initiation pattern".

Preferably, initiation of all of the explosive charges in the upper zone 36 is in a single round. Detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Although, in the above described embodiment, there are 81 blastholes 48 providing 81 explosive charges 50, if desired, other numbers of blastholes having different spacing patterns can be used in practice of this invention. Also, if desired, the blastholes at the corners of the retort can be eliminated.

As mentioned above, preferably the explosive charges 52 in the lower layer of unfragmented formation 38 are detonated at about the same time, in about the same detonation sequence, and in the same single round as the charges 50 in the upper zone.

Referring again to FIG. 1, detonation of the explosive charges 50 and 52 in the zones 36 and 38 of unfragmented formation form the fragmented permeable mass 20 with an uneven or non-uniform void fraction distribution in the retort 10. The void fraction of the portion 20*a* of the fragmented mass, i.e., the portion in the center of the retort, is less than the void fraction of the fragmented mass in outer regions of the retort nearer the side boundaries 18. Thus, the center region 20*a* of the fragmented mass has a lower void fraction than the average void fraction of the entire mass.

A fragmented mass 20, as described above, having a low void fraction region at its center, is formed in this instance because when the above described detonation sequence is used, oil shale adjacent the center of each zone commences expanding first, thereby providing relief for expansion of oil shale surrounding the center. As a consequence, there is a general tendency for the expanding oil shale to push or move toward the center of the retort site, i.e., toward the locus of the first detonation. This action in limited void volumes promotes a compression of the fragmented mass near the center of the retort which results in a band or region of relatively low void fraction or permeability in the center and a band of relatively higher void fraction or permeability around the perimeter of the retort.

The tendency to form a low void fraction region in a fragmented permeable mass near the center of the retort can be accentuated by increasing the time intervals between initiation of detonation of sequential groups or bands of charges nearer the periphery of the retort compared to the time intervals between bands nearer the center of the retort. For instance, the time intervals can be increased up to about 10 milliseconds per foot of spacing between adjacent bands of explosive charges nearer the periphery with less time delay between detonation of the bands nearer the center.

Alternatively, or in addition, the tendency toward non-uniformity of void fraction distribution and, in this instance, the tendency for forming a low void fraction region in the fragmented mass near the center of the retort, can be enhanced by increasing the size of the explosive charges near the periphery or by decreasing the size of the charges near the center; that is, by decreasing the scaled point charge depth of burial (SDOB) of such charges at the periphery or by increasing the SDOB of such charges near the center. A similar effect can be obtained by decreasing the spacing distance between charges near the periphery or by increasing the spacing between charges near the center. More energetic expansion of formation near the periphery tends to increase the void fraction in this region. The powder factor (e.g., pounds of explosive per ton of formation) near the periphery should not be increased to the extent that substantial additional fragmenting of formation occurs. The resultant decrease in particle size could counteract the permeability benefits of lower void fraction.

In the above described exemplary embodiment, each explosive charge 50 in the upper zone 36 and each explosive charge 52 in the lower zone 38 has about the same actual depth of burial and about the same scaled depth of burial as each other explosive charge in the same zone.

The actual depth of burial, as used herein, is the distance from the free face toward which formation is to be expanded to the center of the mass of that portion of an explosive charge that expands formation toward that free face. Thus, for example, the effective center of mass or actual depth of burial of each charge 50 is not at the center of the full column of explosive in that blasthole. In this instance, each charge 50 has two effective centers of mass; one at the center of the upper half of the column of explosive, since the upper half of the column expands formation toward the upper free face 40, and one at the center of the lower half of the column of explosive, since the lower half of the column expands formation toward the lower free face 42.

The scaled depth of burial (SDOB) as it is used herein is described by B. B. Redpath in an article entitled "Application of Cratering Characteristics to Conventional Blast Design," *Monograph* 1 *on Rock Mechanics Applications and Mining,* Soc. of Min. Eng. and Am. Inst. of Min. Met. and Pet. Eng., New York (1977). A copy of this article accompanies the application and is incorporated herein by this reference. Briefly, the scaled depth of burial of an explosive charge can be expressed in units of distance over weight to the $\frac{1}{3}$ power or, preferably, distance over energy of explosive to the $\frac{1}{3}$ power. For example, $SDOB = L/W^{\frac{1}{3}}$ with units of millimeters per calorie to the $\frac{1}{3}$ power. The distance, L, referred to as burden distance in the equation for scaled depth of burial, is the actual depth of burial as described hereinabove. The weight or energy, W, of the explosive is that weight or energy of the explosive charge that expands formation toward the free face.

Referring now particularly to FIG. 5, a horizontal cross-sectional view of the upper layer 36 of unfragmented formation is shown illustrating another exemplary pattern of explosive charges 50 provided in accordance with this invention. The charges 52 are in a similar pattern in the zone 38.

In this embodiment, both the upper and lower zones of unfragmented formation 36 and 38 are explosively expanded toward the adjacent voids in four horizontally spaced contiguous regions. Each of the four regions extends vertically between the free faces of the adjacent voids. Each such region, therefore, has a free face at the top and bottom toward which the formation from that region is expanded.

In practice of this invention, each of such four contiguous regions is expanded in a desired number of portions, each of which extends between the adjacent free faces. The first portion of each region expanded is preferably near its center. The portion of each region expanded next is preferably adjacent the first portion and laterally spaced from it. Remaining portions are subsequently expanded in sequence, preferably with each subsequent portion expanded being adjacent the next previously expanded portion.

It is preferable that the first portions of such regions are all explosively expanded about simultaneously and that the second portions of such regions are all explosively expanded about simultaneously. Further, any remaining portions of the region are explosively expanded in sequence with each respective portion of all four regions expanded about simultaneously.

For illustrative purposes, the four contiguous regions of the upper zone 36 are defined by vertical planes 54 and 56, each bisecting the retort, and the explosive charges 50 that are detonated at the same time in each such region are shown connected by dashed lines. The lower zone has four identical contiguous regions spaced directly below the regions of the upper zone.

Preferably, both the upper zone and the lower zone are explosively expanded in about the same sequence of explosive expansions in the same single round. Therefore, explosive expansion of only the upper layer or zone of unfragmented formation is described below in detail. Although it is preferred that the detonation sequence in each zone is the same, when, for example, one zone is thicker than the other zone, such a detonation sequence can be started in one of the zones before it is started in the other.

The voids 30, 32, and 34 and the zones of unfragmented formation 36 and 38 are, in this embodiment, square in horizontal cross-section and preferably each quadrant of each such zone is about the same size as each other quadrant. The quadrants have square free faces which meet at a common corner at the center of the zone. In other embodiments, voids and the zones of unfragmented formation extending between such voids can have horizontal cross-sections other than square and the regions being expanded can be other than square if desired. Additionally, when the zone of unfragmented formation being expanded is not square in horizontal cross-section, it can be expanded in regions having square horizontal cross-sections.

The blasting pattern used when expanding a zone of unfragmented formation in four contiguous regions is referred to herein as a "quadrant initiation pattern."

In an exemplary charge initiation sequence, when using such a "quadrant initiation pattern," five first explosive charges **50*h* at about the center of each region or quadrant are detonated first. Detonation of the five charges 50*h* expands a first portion of each such region toward the voids 30 and 32. In this instance, the first portions extend from the free face 40 to the free face 42 and are located at about the center of their respective regions. The free faces at the ends of the first portion of each region are, therefore, at about the center of the area of the free faces of that region. Next, after a short time delay, eight explosive charges 50*i* spaced radially from the center portion of each region and in a band surrounding the initial charges 50*h* are detonated. The time delay between detonation of the first explosive charges 50*h* and the second explosive charges 50*i* is preferably at least about 1 millisecond per foot of spacing between adjacent explosive charges 50*h* and 50*i***.

Detonation of the eight explosive charges **50*i* expands a second portion of each region toward the voids. The second portion expanded is adjacent the first portion, surrounds the first portion, and extends from the free face 40 to the free face 42**. The free face of such a second portion at each of its ends is, therefore, adjacent the free face of the first portion and surrounds the free face of the first portion.

Next, the explosive charges **50*j*, i.e., the next group or band of explosive charges spaced laterally outwardly from the charges 50*i*, are detonated after a time delay of at least about 1 millisecond per foot of spacing between adjacent charges 50*i* and 50*j*. If desired, detonation of the charges 50*j* near the center of the retort can be delayed until after the other charges 50*j*** are detonated for forming a center region of the fragmented mass with even less permeability.

As described above, the sequence of initiation of detonation of explosive charges progresses generally radially outwardly from the center of each quadrant or region of the upper layer 36 until all explosive charges in the upper layer are detonated.

As is mentioned above, the lower layer of unfragmented formation 38 is preferably explosively expanded in the same single round as the upper layer using the same detonation sequence and pattern of explosive charges.

Referring again to FIG. 1, the fragmented permeable mass 20 formed in a retort 10 has a central region **20*a* with a lower void fraction than outer regions of the fragmented mass nearer the side boundaries. In this embodiment of forming such a fragmented mass, the above described distribution of void fraction results because the charges 50*j* in the center of the upper zone and the charges 52*j* in the center of the lower zone are detonated after the charges at the center of the quadrants. It has been found that when the charges at about the center of such a pattern, i.e., charges 50*j* and 52*j*, are detonated after the charges in the center of the quadrants, there is less room for expansion of the formation expanded by such charges 50*j* and 52*j***. Since, in this instance, the center portion of formation cannot expand as much as the portions previously expanded, the fragmented mass formed from such a portion has a relatively lower void fraction.

Once again, to accentuate the non-uniform distribution of void fraction, the time intervals between sequential detonations can be varied as desired. Alternatively, or in addition, the size of the explosive charges near the periphery of the retort can be larger than the size of the charges near its center.

In yet another exemplary embodiment, preferably when a retort has a plurality of inlets along one upper edge and a plurality of outlets along an opposite lower edge, the explosive charges can be detonated in rows. In this technique, the rows of charges are about parallel to the planes of the side boundaries through which the inlets and outlets are formed. Preferably, a row of charges near the center of the retort is detonated first, followed sequentially by detonation of rows moving laterally toward the inlet and outlet side boundaries.

Although three voids are used in the above described embodiments, more than three voids can be used if desired. The zones of unfragmented formation between each pair of such voids can be explosively expanded toward the voids using the "quadrant initiation sequence," "center-out initiation sequence," or the sequence described above for detonating the charges in rows. Also, if desired, one of the zones can be expanded using one of the exemplary sequences and the other zone can be expanded using a different exemplary sequence.

Alternatively, retorts can be formed according to this invention using only two voids with one zone of unfragmented formation between the voids. In this instance, the single zone of unfragmented formation is expanded upwardly and downwardly toward both voids. In yet another alternative embodiment, explosive expansion of a single zone of unfragmented formation can be directed either upwardly toward a single void or downwardly toward a single void using a detonation sequence and pattern of explosive charges, as described above, in any of the exemplary embodiments. When expanding a zone of formation toward a single void or two or more voids, such a zone can be expanded in a plurality of layers or lifts, if desired.

After the unfragmented formation is explosively expanded for forming the fragmented permeable mass 12 of oil shale particles in the in situ oil shale retort 10, as is illustrated in FIG. 1, retorting operations can be commenced.

During retorting operations, a combustion zone is established in the fragmented mass of formation particles adjacent the inlet 22 and an oxygen-supplying gas such as air or air diluted with oxygen, as described above, is introduced through the inlet for sustaining the combustion zone and for advancing it diagonally from the inlet toward the outlet 24.

Because of the above described non-uniform distribution of void fraction, the flatness of the combustion zone is enhanced as it moves from the inlet diagonally toward the outlet.

Combustion gas produced in the combustion zone as it advances through the retort establishes a retorting zone on the advancing side of the combustion zone where kerogen in oil shale is retorted to produce liquid and gaseous products. The liquid products, including shale oil and the off-gas containing gaseous products, both pass to the retort outlet(s) 24. The liquid products and the off-gas are separately withdrawn from the outlet.

Both "quadrant" and "center-out" initiation patterns for detonating an array of explosive charges are disclosed and claimed in U.S. patent application Ser. No. 277,852, filed by me on June 26, 1981. U.S. patent application Ser. No. 277,852 is assigned to Occidental Oil Shale, Inc., is entitled "Formation of an In Situ Oil Shale Retort with Control of Mounding," and is incorporated herein by this reference. A "center-out" initiation pattern for detonating an array of explosive charges is also disclosed and claimed in U.S. patent application Ser. No. 192,330, now U.S. Pat. No. 4,372,615, filed by me on Sept. 29, 1980. U.S. patent application Ser. No. 192,330, which is a continuation of U.S. patent application Ser. No. 075,846 (now abandoned), filed Sept. 14, 1979, is assigned to Occidental Oil Shale, Inc., is entitled "Method of Rubbling Oil Shale," and is incorporated herein by this reference.

The above description of methods for forming retorts and for retorting in accordance with practice of this invention is for illustrative purposes. Because of variations which will be apparent to those skilled in the art, the present invention is not intended to be limited to the particular embodiments described above. The scope of the invention is defined in the following claims.

What is claimed is:

1. A method for forming an in situ oil shale retort in a retort site in a subterranean formation containing oil shale, the in situ oil shale retort site having top, bottom, and side boundaries of unfragmented formation, the method comprising the steps of:

excavating at least one void in the subterranean formation within the boundaries of the retort site while leaving a zone of unfragmented formation within the boundaries of the retort site having a horizontal free face adjacent such a void;

loading explosive into such a zone of unfragmented formation;

detonating the explosive in the zone of unfragmented formation in a time delay sequence in a single round for expanding the zone of unfragmented formation toward such a void for forming a fragmented permeable mass of formation particles within the boundaries of the retort site, comprising the steps of:

detonating explosive near the center of the zone of unfragmented formation; and thereafter detonating explosive in the zone of unfragmented formation progressing radially outwardly from the center of such a zone to thereby explosively expand the zone of unfragmented formation toward the void for forming the fragmented permeable mass of formation particles in the retort, such a fragmented permeable mass having a lower permeability in a center region of the retort and a higher permeability in outer regions of the retort adjacent the side boundaries;

forming at least one retort inlet adjacent the intersection of a first side boundary of the retort site and the top boundary of the retort site for introduction of a retort inlet mixture; and forming at least one retort outlet adjacent the intersection of a second side boundary of the retort site and the bottom boundary of the retort site for withdrawal of off-gas, the second side boundary being on the opposite side of the fragmented mass from the first side boundary.

2. The method according to claim 1 wherein the void is a horizontally extending limited void.

3. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, comprising the steps of:

excavating at least one void in the subterranean formation within the boundaries of the retort site while leaving a zone of unfragmented formation within the boundaries of the retort site adjacent such a void, the zone of unfragmented formation comprising four contiguous regions, each such region having a horizontally extending free face adjacent the void;

forming an array of explosive charges in the zone of unfragmented formation, the array comprising at least one first explosive charge in a central portion of each such region of the zone of unfragmented formation surrounded by a plurality of second explosive charges in a portion of each such region laterally spaced apart from the central portion and adjacent the central portion;

detonating the explosive charges in a single round for explosively expanding the zone of unfragmented formation toward the void for forming the fragmented permeable mass of formation particles in the in situ oil shale retort by:

detonating the first explosive charges in each such region of the zone of unfragmented formation for explosively expanding the central portion of each such region toward the void; and thereafter detonating the second explosive charges in each such region of the zone of unfragmented formation for explosively expanding the portion of each region laterally spaced from the central portion and adjacent the central portion toward the void to thereby form such a fragmented permeable mass having a permeability in a center region of the retort that is less than the permeability in regions of the retort nearer the retort side boundaries;

forming at least one retort inlet in a zone of the retort adjacent the intersection of a first side boundary of the retort site and the top boundary of the retort site for introduction of a retort inlet mixture; and forming at least one retort outlet in a zone of the retort adjacent the intersection of a second side boundary of the retort site and the bottom boundary of the retort site for withdrawal of off-gas, the second side boundary being on the opposite side of the fragmented mass from the first side boundary.

4. The method according to claim 3 wherein such a void is a horizontally extending limited void.

5. The method according to claim 4 wherein the void is generally square in horizontal cross-section and each such region comprises one generally square quadrant adjacent the void.

6. The method according to claim 3 wherein a time delay between detonation of the first explosive charges and detonation of the second explosive charges is at least about 1 millisecond per foot of distance between a first explosive charge and an adjacent second explosive charge.

7. A method for forming an in situ oil shale retort in a retort site in a subterranean formation containing oil shale, such an in situ oil shale retort containing a fragmented permeable mass of formation particles containing oil shale formed within top, bottom, and side boundaries of the retort site, comprising the steps of:

excavating at least one void in the subterranean formation within the boundaries of the retort site, while leaving a zone of unfragmented formation within the boundaries of the retort site adjacent such a void;

forming at least one retort inlet in a zone of the retort adjacent the intersection of a first side boundary of the retort site and the top boundary of the retort site for introduction of a retort inlet mixture;

forming at least one retort outlet in a zone of the retort adjacent the intersection of a second side boundary of the retort site and the bottom boundary of the retort site for withdrawal of off-gas, the second side boundary being on the opposite side of the retort site from the first side boundary;

forming an array of horizontally spaced apart explosive charges in the zone of unfragmented formation, the array extending across substantially the entire horizontal cross-section of the zone of unfragmented formation; and detonating the explosive charges in a single round in a time delay sequence for explosively expanding the zone of unfragmented formation toward the void for forming a fragmented permeable mass of formation particles within the boundaries of the retort site, comprising the steps of:

detonating at least one first explosive charge located at about the center of the zone of unfragmented formation; and after a first time delay detonating explosive charges progressing in bands generally radially outwardly from such a first explosive charge, there being a time delay between detonation of each successive band of explosive charges for forming such a fragmented permeable mass of formation particles in the retort having a lower permeability in a center region of the retort and a higher permeability in regions of the retort adjacent the side boundaries.

8. The method according to claim 7 wherein the spacing distance between adjacent explosive charges in the array is about equal.

9. The method according to claim 8 wherein the time delay between detonation of successive bands of explosive charges is at least about 1 millisecond per foot of distance between adjacent bands of explosive charges.

10. The method according to claim 7 wherein the scaled depth of burial of the explosive charges in the center region of the zone of unfragmented formation is greater than the scaled depth of burial of explosive charges more remote from the center region.

11. The method according to claim 7 wherein the time delay interval between detonation of successive bands of explosive charges near the center of the zone of unfragmented formation is less than the time delay interval between detonation of successive bands of explosive charges more remote from the center of the zone of unfragmented formation.

12. The method according to claim 7 wherein the void is a horizontally extending limited void.

13. A method for recovering gaseous and liquid products from an in situ oil shale retort in a retort site in a subterranean formation containing oil shale, such an in situ oil shale retort containing a fragmented permeable mass of formation particles containing oil shale formed within top, bottom, and side boundaries of the retort site, comprising the steps of:

excavating at least one horizontally extending void in the subterranean formation within the boundaries of the retort site, while leaving a zone of unfragmented formation within the boundaries of the retort site adjacent such a void;

explosively expanding such a zone of unfragmented formation for forming a fragmented permeable mass of formation particles within the retort boundaries, the fragmented mass having a lower permeability region near its center and a higher permeability region near its outside;

introducing a retort inlet mixture into the retort at a first upper edge;

withdrawing off-gas from the retort at a first lower edge, the first upper edge being on the opposite side of the retort from the first lower edge;

advancing a combustion zone diagonally through the lower and higher permeability regions of the fragmented mass from the first upper edge toward the first lower edge for forming gaseous and liquid products; and withdrawing such gaseous and liquid products from the fragmented mass at the first lower edge.

* * * * *